US007982377B2

(12) United States Patent
Haacke et al.

(10) Patent No.: US 7,982,377 B2
(45) Date of Patent: Jul. 19, 2011

(54) HIGH-PRESSURE GAS DISCHARGE LAMP

(75) Inventors: Michael Haacke, Aachen (DE); Pieter Postma, Roosteren (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 516 days.

(21) Appl. No.: 11/577,436

(22) PCT Filed: Oct. 6, 2005

(86) PCT No.: PCT/IB2005/053283

§ 371 (c)(1),
(2), (4) Date: Apr. 18, 2007

(87) PCT Pub. No.: WO2006/043184

PCT Pub. Date: Apr. 27, 2006

(65) Prior Publication Data

US 2009/0189501 A1 Jul. 30, 2009

(51) Int. Cl.
*H01J 61/52* (2006.01)
*H01J 1/02* (2006.01)
*H01K 1/58* (2006.01)

(52) U.S. Cl. ..... 313/39; 313/620; 313/634; 313/570; 313/623

(58) Field of Classification Search ..... 313/39, 313/571, 620, 634, 570, 623; 315/246, 77
See application file for complete search history.

(56) References Cited

U.S. PATENT DOCUMENTS

| | | | | |
|---|---|---|---|---|
| 4,594,529 | A * | 6/1986 | de Vrijer | 313/571 |
| 5,117,154 | A | 5/1992 | Thomas et al. | |
| 5,471,110 | A * | 11/1995 | van der Leeuw et al. | 313/25 |
| 5,481,159 | A * | 1/1996 | Hiramoto et al. | 313/570 |
| 5,973,453 | A * | 10/1999 | Van Vliet et al. | 313/623 |
| 5,986,402 | A * | 11/1999 | Narita et al. | 313/620 |
| 6,307,321 | B1 * | 10/2001 | Honda et al. | 313/634 |
| 6,495,962 | B2 * | 12/2002 | Uemura et al. | 315/77 |
| 6,580,200 | B2 * | 6/2003 | Fukuyo et al. | 313/25 |
| 6,661,174 | B2 * | 12/2003 | Eastlund et al. | 313/634 |
| 6,667,575 | B2 * | 12/2003 | Nishida | 313/631 |
| 2002/0067141 | A1 * | 6/2002 | Schoeller et al. | 315/246 |
| 2003/0052610 | A1 | 3/2003 | Takagaki et al. | |
| 2004/0150344 | A1 | 8/2004 | Takagaki et al. | |
| 2005/0168176 | A1 * | 8/2005 | Stockwald | 315/312 |
| 2005/0248278 | A1 * | 11/2005 | Wijenberg et al. | 313/639 |
| 2007/0182332 | A1 * | 8/2007 | Haacke et al. | 313/633 |

FOREIGN PATENT DOCUMENTS

| | | | |
|---|---|---|---|
| EP | 1107285 | A | 6/2001 |
| EP | 1351276 | A2 | 10/2003 |
| WO | 02099146 | A | 12/2002 |
| WO | 03060947 | A | 7/2003 |
| WO | WO 03060946 | A2 * | 7/2003 |
| WO | WO 2004023517 | A1 * | 3/2004 |
| WO | WO 2004105082 | A2 * | 12/2004 |
| WO | WO 2005006819 | A1 * | 1/2005 |

* cited by examiner

*Primary Examiner* — Nimeshkumar D Patel
*Assistant Examiner* — Glenn Zimmerman

(57) ABSTRACT

A high-pressure gas discharge lamp includes at least a lamp tube and two electrodes. The two electrodes are each attached to the lamp tube by a sealed area and, outside the sealed area, each electrode has a perpendicular minimum distance, with respect to its longitudinal axis, from the lamp tube.

4 Claims, 1 Drawing Sheet

HIGH-PRESSURE GAS DISCHARGE LAMP

Figure 1:
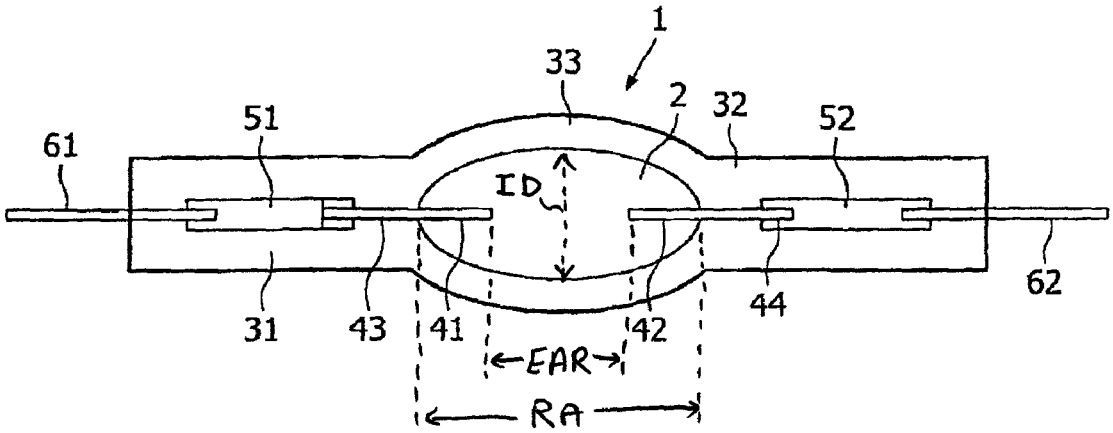

The invention relates to a high-pressure gas discharge lamp comprising at least a lamp tube and two electrodes, wherein the two electrodes are each attached to the lamp tube by a sealed area and, outside the sealed area, each electrode has a perpendicular minimum distance, with respect to its longitudinal axis, from the lamp tube.

On account of their optical properties, high-pressure gas discharge lamps [xenon HID (high intensity discharge) lamps] are preferably used inter alia in automotive technology, in particular in front headlamps. Within the context of the invention, the term xenon HID lamp also includes similar lamps made by other manufacturers.

High-pressure gas discharge lamps usually have two electrodes which both fulfill the anode and cathode function in AC operation. These electrodes are often arranged opposite one another in a discharge chamber which is located in the lamp tube. The electrodes in each case have a tip at one of their ends and the electrode base at their other end. The electrode base is connected to the lamp tube, which is usually made of quartz or hard glass.

During operation of the lamp, the highest temperature of the lamp tube is usually found in the area where the electrode base enters the lamp tube.

The distance of the tip of the electrode from the area where the electrode base enters the lamp tube, where the electrode is completely surrounded for the first time, is known as the free path length of the electrode. For technological reasons, the so-called groove, where the material of the lamp tube completely surrounds the electrode base for the first time, is also usually located in this region. A notching in the geometric sense can usually be found at the location of the groove; however, this notching at the location of the groove cannot be found in every case. The distance between the location of the groove of the first electrode and the location of the groove of the second electrode is known as the groove spacing.

The discharge chamber of the high-pressure gas discharge lamp is hermetically sealed and filled in particular with an inert gas. An arc discharge is produced in the discharge chamber between the opposed tips of the electrodes, wherein the arc serves as a light source of the high-pressure gas discharge lamp.

Energy is introduced through the internal electrodes, which are preferably made of tungsten. The electrodes are usually connected to an external ballast via molybdenum. The molybdenum is usually formed as a molybdenum film or tape and a molybdenum wire. The gas-tight closure is usually produced by at least one gas-tight sealed area between the glass-like material, usually quartz, and molybdenum.

The sealed area may be designed in a known manner as a so-called pinched seal or molybdenum film seal. Since the thermal expansion coefficients of quartz glass and molybdenum are very different, shrinkage of the molybdenum in the sealed area is unavoidable in the event of considerable temperature fluctuations. The gas-tight closure of the sealed area is ensured by the dimensioning of the molybdenum, in particular of the molybdenum film, and of the sealed area.

For functional reasons, there must be a minimum distance between the electrodes or the arc of the gas discharge and the lamp tube. For example, too small a distance between the inner surface of the lamp tube and the arc will lead to increased crystallization, by virtue of which the service life of the lamp will be shortened. The thermal loading which acts on the lamp tube under otherwise comparable conditions is smaller in the case of a larger internal diameter.

The service life of the lamp is furthermore influenced inter alia by the fact that, during operation of the lamp, increased undesirable crystallization of the material of the lamp tube takes place in the region of the electrode base or the sealed area. By conducting heat from the electrode, heat is transferred into the region of the sealed area of the lamp tube which serves to attach the electrode to the lamp. Undesirable recrystallization of the quartz material of this region, particularly in the sealed area, cannot be ruled out but must be kept as low as possible.

In order to reduce the transfer of heat into the sealed area, it would in principle be possible to minimize the size of the electrode base for a given maximum lamp power. However, this is restricted by the required mechanical stability, which must be ensured even when handling and transporting the lamp.

In so-called mercury-free lamps, compared to a lamp with a mercury filling, a higher lamp current is usually required in order to achieve a comparable lamp power. For a given maximum lamp power of such a lamp, the size of the electrode base is thus usually larger.

If such an increase in the maximum lamp power is required on account of the use thereof, an increase in the size of the electrode base is usually also necessary, and this results in an undesirably increased heat transfer.

When using the lamp in automotive technology, in particular in front headlamps, the installation situation and the cooperation with the reflector must be taken into account when designing the lamp. For this reason, inter alia, the optical electrode spacing has been standardized in accordance with regulations and should be approx. 4.2 mm.

The so-called optical electrode spacing need not correspond to the actual electrode spacing determined for example by X-ray, that is to say the X-rayed electrode spacing (EAR). The optical electrode spacing may vary on account of the different lens effect of the lamp tube or in particular the internal shape thereof; for example there are considerable differences between cylindrical and elliptical internal shapes.

By way of example, EP 05700681 B1 discloses a high-pressure gas discharge lamp comprising at least a lamp tube and two electrodes, wherein the two electrodes are attached to the lamp tube by a sealed area and, outside the sealed area, each electrode has a perpendicular minimum distance, with respect to its longitudinal axis, from the lamp tube. This type of lamp is commercially available, for example from Philips in the type D2. Such a mercury-free lamp is preferably used in automotive technology, in particular in front headlamps.

The optical electrode spacing is 4.2 mm; the X-rayed electrode spacing (EAR) is approx. 3.7 mm. The electrodes consist mainly of a tungsten material, are in each case approximately 6.0 mm long, and the free path length of each electrode is 1.8 mm. The groove spacing (RA) is 7.4 mm.

For a maximum perpendicular diameter (ID) of 2.7 mm, a value of 20.0 $mm^2$ is obtained for the product of RA and ID.

It is an object of the invention to provide a high-pressure gas discharge lamp of the type mentioned above, in which the heat transfer from the electrode into the sealed area of the high-pressure gas discharge lamp can be limited.

It is essential to the invention that the transfer of heat from at least one of the electrodes into the respective sealed area can be determined by the dimensioning of the free path length of this electrode and the perpendicular distance between this electrode and the lamp tube outside the sealed area.

Within the context of the invention, the free path length of the electrode is the length from the electrode tip to the sealed area, that is to say half the difference of groove spacing (RA) and electrode spacing. The abovementioned parameters, such as the electrode spacing, are actual values which can be determined for example by X-ray, and is therefore for example the X-rayed electrode spacing (EAR).

The solution according to the invention means that the operating temperature of the lamp can be significantly reduced in the sealed area of the high-pressure gas discharge lamp.

By virtue of the greater free path length of the electrode according to the invention, a reduced transfer of heat per unit time takes place in the region of the sealed area of the lamp tube. The risk of undesirable recrystallization of the quartz material of this region, in particular in the sealed area, is thus limited.

The electrode head and also the tip thereof are made of the conventional electrode materials, are designed in particular to be solid, and may be differently shaped, for example in the shape of a cylinder, a cone or even a sphere.

The parts of the electrode, such as the electrode head and the electrode base, are permanently connected to one another by methods known per se or in a known manner. Use may be made for example of known methods of welding or laser technology or else grinding methods. Individual parts, a number of parts or all parts may be produced together or separately and connected to one another.

It is preferred that the dimensioning of the free path length of this electrode can be influenced by the length of the groove spacing. By increasing the groove spacing, the transfer of heat in the so-called run-up but also in the so-called steady state (continuous operation) can be significantly reduced.

It is furthermore preferred that the region of the electrode base has design features, such as a reduced cross section for example, such that the heat conduction there is lower than in the electrode head. This is particularly relevant in electrodes with a relatively large cross section of the electrode head.

There are many thermodynamic aspects known per se, such as design measures which bring about improved cooling, in particular on account of improved conditions for heat transfer, such as for example the arrangement of cooling ribs, and these may independently thereof be advantageous within the context of the invention.

Besides design measures, this also relates to the choice of materials with regard to the physical properties thereof, such as the density.

When the lamp according to the invention is a mercury-free high-pressure gas discharge lamp, it is preferred that, in the case of an optical electrode spacing of approx. 4.2 mm, the dimensioning of groove spacing (RA) and maximum perpendicular internal diameter (ID) is selected such that the product of RA and ID is at least 18.5 $mm^2$, wherein the maximum perpendicular internal diameter (ID) is less than 2.7 mm. It is furthermore preferred that the product of RA and ID lies in the range from 19.0 to 19.9 $mm^2$, at most 25.0 $mm^2$.

It is moreover preferred that, in the case of an optical electrode spacing of approx. 4.2 mm, the dimensioning of groove spacing (RA), maximum perpendicular internal diameter (ID) and the X-rayed electrode spacing (EAR) is selected in such a way that the product of ID and the difference of RA and EAR is at least 9.5 $mm^2$, wherein the maximum perpendicular internal diameter (ID) is less than 2.7 mm.

It is furthermore preferred that the product of ID and the difference of RA and EAR lies in the range from 10.3 to 11.5 $mm^2$, at most 15.0 $mm^2$. It is moreover preferred that the lamp filling is Hg-free, wherein lamps in the context of the invention may also be high-pressure gas discharge lamps with a mercury filling.

It is furthermore preferred that the lamp and lamp constituents are free of thorium.

The object of the invention is also achieved by a front headlamp comprising at least one high-pressure gas discharge lamp in accordance with the features of claims 1 to 9.

The invention will be further described with reference to an example of embodiment shown in the drawing to which, however, the invention is not restricted.

FIG. 1 shows a schematic sectional diagram of a lamp tube of a xenon HID high-pressure gas discharge lamp with an electrode arrangement.

FIG. 1 schematically shows in a sectional diagram a lamp tube 1 with a discharge chamber 2 of a xenon HID high-pressure gas discharge lamp for a front headlamp of a car. The lamp tube 1, which is made in one piece and hermetically seals a discharge chamber 2 filled with a gas conventionally used for this purpose, the material of said lamp tube usually being quartz glass, comprises two cylindrical regions of the sealed areas 31, 32 which lie opposite one another and between which there is a region 33 with a maximum perpendicular diameter (ID) of approximately 2.4 mm, that is to say measured perpendicular to the longitudinal axis of the lamp, which in this case is also the longest axis of symmetry of the lamp.

The electrode arrangement essentially comprises a first electrode 41 and a second electrode 42, between the opposed tips of which an arc discharge is produced in the discharge chamber 2, wherein the arc serves as a light source of the high-pressure gas discharge lamp.

The optical electrode spacing is 4.2 mm; the X-rayed electrode spacing (EAR) is approximately 3.6 mm in the case of a cylindrical inner contour of the region 33 (not shown in FIG. 1).

The ends of the electrodes 41, 42, that is to say the electrode bases 43, 44, are connected to the molybdenum wires 61, 62 via the molybdenum tapes 51, 52. The molybdenum wires 61, 62 are furthermore connected to the electrical terminals of the lamp (not shown in FIG. 1), via which the supply voltage required to operate the lamp is fed by a power supply, possibly with a ballast, designed for a general mains voltage.

The electrodes 41, 42 mainly consist of a tungsten material, are shaped in a cylindrical manner and are each approximately 6 mm long; the free path length of the electrodes 41, 42 is 2.2 mm and the electrode base 43 and 44 in each case has a diameter of approximately 0.3 mm. The groove spacing (RA) is 8.0 mm.

For a maximum perpendicular diameter (ID) of 2.4 mm, a value of 19.2 $mm^2$ is obtained for the product of RA and ID.

A value of approximately 10.6 $mm^2$ is obtained in this case for the product of ID and the difference of RA and EAR.

Compared to a customary groove spacing of RA=7.4 mm and an ID of 2.4 mm, a lower temperature in the region of the sealed area is obtained in the lamp according to the invention. This temperature difference is approximately 100-200 K during the run-up and approximately 50-100 K in continuous operation.

The invention claimed is:

1. A high-pressure gas discharge lamp, at least comprising a lamp tube and two electrodes, wherein the two electrodes are each attached to the lamp tube by a respective sealed area, wherein a length RA between grooves that are located where each of the two electrodes enters the respective sealed area from a discharge chamber side of the lamp and a maximum perpendicular internal diameter ID of the lamp tube is selected such that a product of RA and ID is 25 $mm^2$, wherein a product of the ID and a difference of the RA and the EAR is at least 10 $mm^2$, wherein a spacing between the electrodes is an X-rayed electrode spacing EAR and the EAR is between 3.6 mm to 3.7 mm, and wherein the maximum perpendicular internal diameter ID is between 2.4 and 2.7 mm.

2. The lamp as claimed in claim 1, wherein the lamp filling is Hg-free.

3. The lamp as claimed in claim 1, wherein the lamp and lamp constituents are free of thorium.

4. A front headlamp for cars, comprising at least one high-pressure gas discharge lamp as claimed in claim 1.

* * * * *